United States Patent [19]

Jones

[11] Patent Number: 4,971,043

[45] Date of Patent: Nov. 20, 1990

[54] SELF ACTUATED CERVICAL TRACTION MACHINE

[76] Inventor: J. Paul Jones, 413 N. Saddlebrook Cir., Chester Springs, Pa. 19425

[21] Appl. No.: 155,508

[22] Filed: Feb. 12, 1988

[51] Int. Cl.[5] ..... A61H 1/02

[52] U.S. Cl. ..... 128/75; 128/87 B

[58] Field of Search ..... 128/75 84 R, 84 C, 69, 128/71, 76 R, 76 B, 774, 777, 779, 781, 782, 87 B; 73/862.03, 862.53, 379; 340/665, 668, 685, 666

[56] References Cited

U.S. PATENT DOCUMENTS

| | | | |
|---|---|---|---|
| 730,477 | 6/1903 | Ryan | 73/862.53 |
| 761,504 | 5/1904 | Kleinbach | 128/75 |
| 963,890 | 7/1910 | Haas | 128/75 |
| 3,105,489 | 10/1963 | Zivi | 128/75 |
| 3,168,094 | 2/1965 | Siltamaki | 128/75 |
| 4,384,425 | 5/1983 | Lemons | 340/668 |
| 4,407,274 | 10/1983 | Goodley | 128/69 |
| 4,586,495 | 5/1986 | Petrofsky | 128/782 |
| 4,667,685 | 5/1987 | Fine | 128/782 |

FOREIGN PATENT DOCUMENTS

| | | | |
|---|---|---|---|
| 8302052 | 6/1983 | PCT Int'l Appl. | 128/781 |

*Primary Examiner*—Edgar S. Burr
*Assistant Examiner*—Huong Q. Pham

[57] ABSTRACT

This invention relates to the field of Cyclic Traction Machines for the human back and, in particular, to a self-actuated portable machine for exercising the Cervical Area; and which occupies very little space on a wall above a stool on which the operator sits. The machine incorporates the principal of audio feedback signals to the operator, to monitor and make the operator aware of when he has reached preset pressure limits; and to communicate preselected interval and dwell time settings.

An easily attached harness grips the chin and head of the operator. A pair of head grips, located at seat level, are attached to the two ends of a rope cable, which goes up and over and opposing pair of pulleys in the wall mounted unit. There is a center loop around a pulley which lifts a pressure monitoring unit; which contains the electronics for producing audio feedback signals. The monitor unit is connected to the head harness on the operator.

Depressing the hand grips on both ends of the rope lifts both shoulders with a force that is equal to the depression force; while the head harness is raised with a force that is twice the force exerted upward on each shoulder. The supporting lift to both shoulders is always balanced, regardless of the relative positions of the operators arms or their relative movement.

4 Claims, 3 Drawing Sheets

SELF ACTUATED CERVICAL TRACTION MACHINE

This invention relates to the field of Cyclic Traction Machines for the Cervical Area of the Human Back and, in particular, to a self actuated machine which occupies very little space on a wall above a stool on which the operator sits. Traction (pulling) pressure is applied to a head harness by a rope and pulley system, which is totally controlled by the operator that is receiving treatment. The portable machine incorporates the principal of audio feedback signals to the operator, to communicate preselected Pressure, Stop Interval, and Dwell Time settings.

BACKGROUND

Intermittant Motorized Traction has long been used for the successfull treatment and rehabilitation of a large percentage of human back problems. Generally, the patient that is undergoing treatment lays in a horizontal position, and is sometimes strapped at the waist or the feet to avoid movement when traction is mechanically applied to either extremity of the body. Motorized machines are also available that apply traction to the head and spinal column while the patient is sitting below the machine. While in the sitting position, the lower part of the body acts as a counter weight to the vertical force that is applied to the head harness on the patient.

While the value of intermittant traction for curing back problems has long been known in the medical field, it has not reached wide spread use because of some basic inhibiting factors. For the doctors in private practice, the Motorized Machines have proven cumbersome bacause of the space they require—in most cases a special room—and they all require a trained attendant to strap in the patient and monitor the action of the machine. This is obviously because of the chance that the motorized machine could experience some kind of mechanical failure, and possibly cause some injury for which the physician could be held liable.

The special requirement of expensive space and a special attendant, which is not constantly required, adds up to an "over head" that the private doctors claim "will not be accepted by the patient."; and especially for the extended treatments that are usually required to complete a cure. Some doctors have stated that a patient with a degenerating back condition should have the means to apply self treatment on a continuing basis—and particularly when some over-exertion agravates the condition.

The economics of the situation, they state, requires that the self-help equipmant should cost no more than approximately ten visits to the doctors office. The logic being that, after several initial visits, the doctor could prescribe the portable self help machine for no more than the cost of the actually required number of visits. The equipment that is distributed through the Medical Equipment Rental Stores must also be made to be both portable, and inexpensive enough to pay off quickly for the store.

It is obvious from the discussion of the inhibiting factors to the wide spread use of cyclic traction for back rehabilitation, that a successful machine for self help must be both economical and portable, as well as circumventing the need for an attendant; by putting the generation of the traction force completely in the hands of the operator/patient—such as with any simple exercise equipment.

It is, therefore, one object of this invention to provide a portable Traction Machine that is very inexpensive in basic design, and which may be totally controlled by the operator who is receiveing treatment, thereby eliminating the need for an attendant.

It is another object of this invention to provide a self monitoring machine that produces audio feedback signals, in the form of beeps, that tell the operator, (1) When he has reached a preset limit of pressure, (2) When he has reached five pounds over the Preset Pressure, (3) How long to hold the preset Dwell Time at the maximum traction, and (4) When to start each new cycle, as preset into the monitor.

It is yet another object of this invention to provide a machine that generates vertical traction to the head and upper portion of the cervical area of the spinal column, by the use of the arms of the operator, which when used to press down on a pair of hand stirrups, exert an upward pressure on the head, and an upward pressure on both shoulders which is always one-half of the pressure applied to the head, and which removes a good portion of the dead weight of the arms and upper portion of the body; thus enabling more of the monitored traction pressure to be applied to the upper portion of the spinal column.

Still another object of this invention is to conveniently apply Cyclic Traction Pressure to the head and upper portion of the Spinal Column of an operator; through a pulley linkage that also applies a balanced upward pressure on both shoulders that is always one-half of the upward pressure on the head, regardless of the relative position of each arm. In the human skeleton there is a semi-rigid connection between the upper spinal column and the shoulder bones; which then connect to the arms. This connection carries a good portion of the weight of the upper torso. When traction pressure is applied to the Head and Spinal column in the Cervical (i.e. the seven upper) vertebrae, the shoulder connections and the associated weight of the upper torso tend to isolate the vertebrae that are further below, from the traction force. The 50% lift to the shoulders, that occurs with the operation of the invention, removes a good portion of the shoulder load, and allows the aligning traction force to reach further down into a greater portion of the spine of the operator.

The invention provides an additional feature when it is used in the prescribed manner. When the operator is seated on a stool, with his back against a wall, and he presses downward on the hand stirrups and cords from the machine, the operator is automatically forced into an erect posture, which is perfect for applying Intermittant Traction and aligning the vertebrae of the Spinal Column.

OPERATIONAL DESCRIPTION

Figure 1:
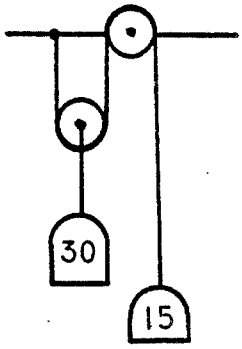
FIG. 1 shows a simple schematic that depicts how a 15 pound weight can lift a thirty pound weight, when it makes a reversal around a fixed Pulley and a moveable pulley, with one end of the rope fixed.
Figure 2:
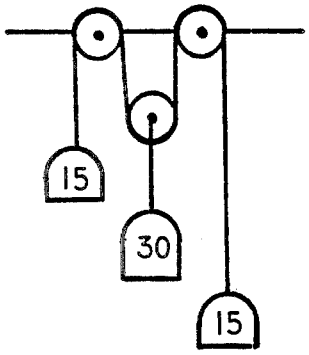
FIG. 2 shows how an additional fixed pulley and an additional 15 pound weight can be used to counter-balance an opposing 15 pound weight, to lift a 30 pound weight on a moving pulley.
Figure 3:
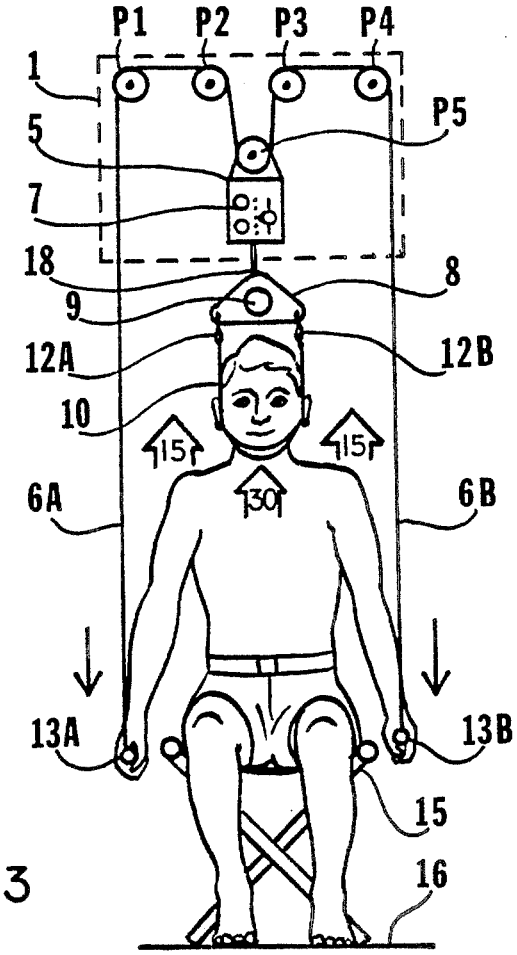
FIG. 3 shows an operator using the pulley system incorporated in the invention.
Figure 4:
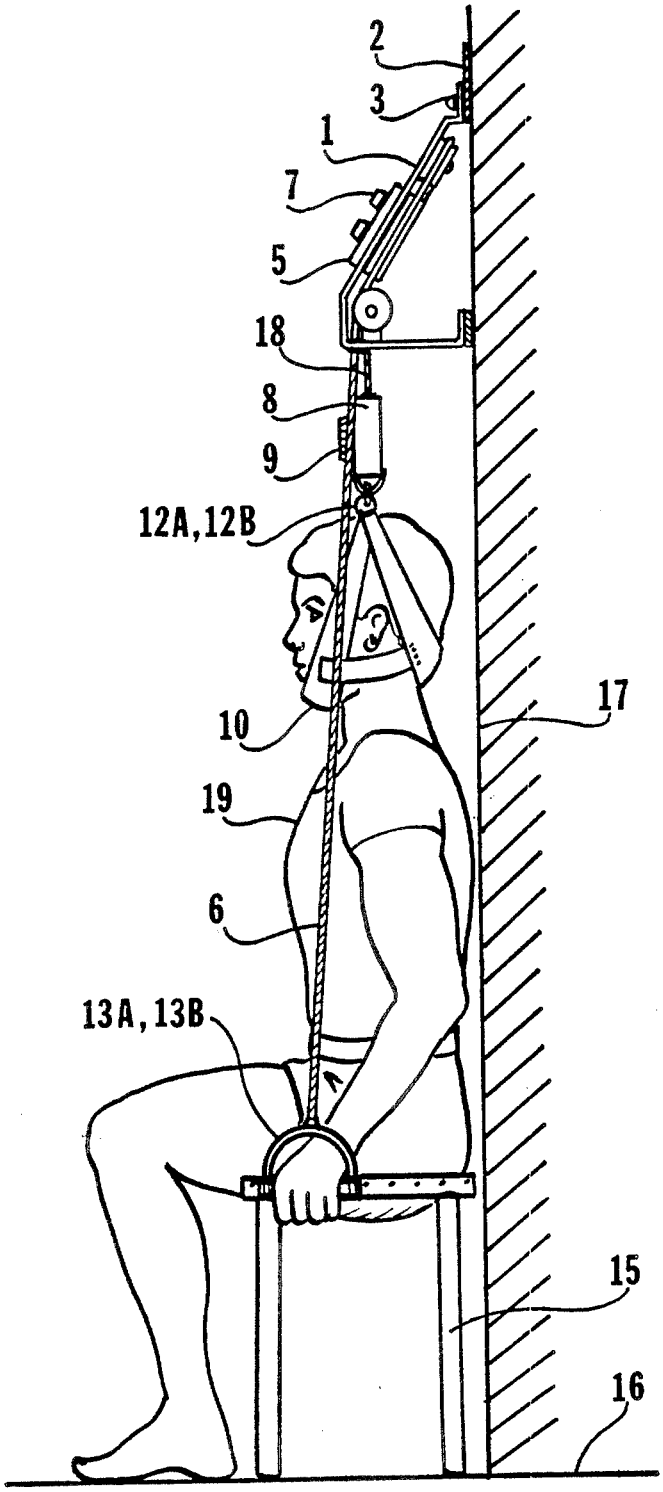
FIG. 4 shows the side view of the system as it is presented in FIG. 3.
Figure 5:
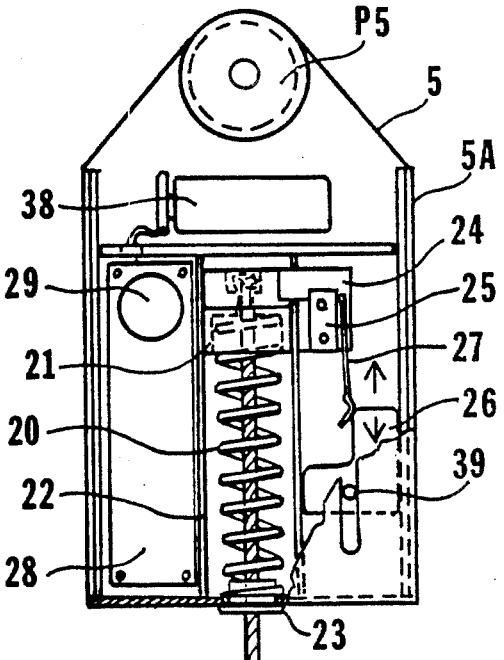
FIGS. 5 and 6 show a detailed view of a Monitor Unit.
Figure 6:
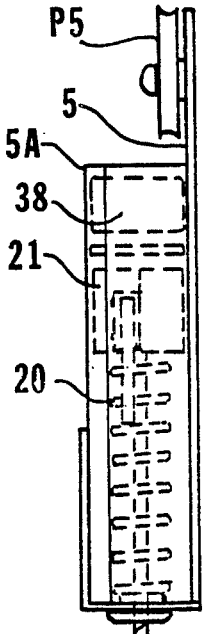
Figure 7:
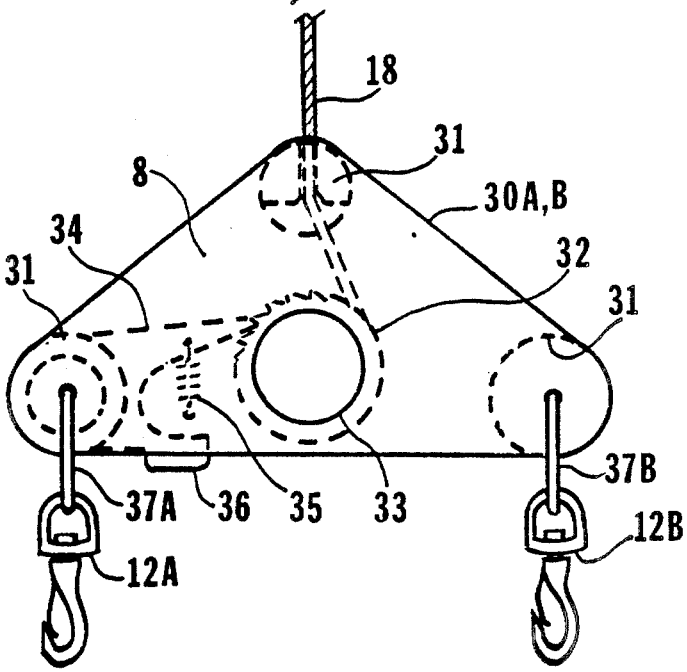
FIGS. 7 and 8 show the details of the Adjustable Hanger Assembly.
Figure 8:
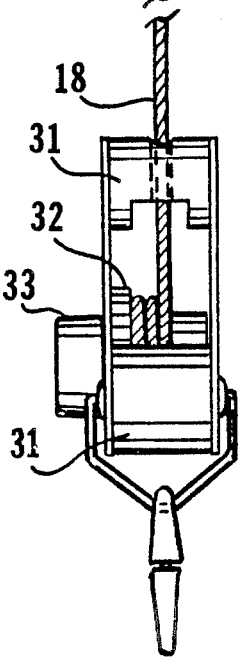

The PHYSICAL FEATURES of the Cervical Traction Invention include (1) Real Portability—it is small enough to fit into a large typewriter case; (2) Quick and Easy Set-Up—There are means to quickly mount the system on any wall or door; (3) Quick Connect and Disconnect at fixed locations. It is easy to take down, store, and set-up again without requiring the total initial set-up; and (4) The system only requires a folding chair to complete its total set-up.

The OPERATIONAL FEATURES include;

1. When installed, the system may be adjusted to any persons height or head contour.

2. The Traction Pressure applied to the Cervical Area of the Spine of the Operator is in complete control of the operator at all times.

3. The Electronic Monitor tells the operator, by electronic Beeps (A) when the Preset Pressure Limit has been reached, (B) when the operator has Exceeded the Limit by five pounds, (C) how long to hold the maximum traction pressure at its peak, and (D) when to start a new traction cycle. The battery operated Monitor Unit also has the feature of AUTOMATIC TURN ON and AUTOMATIC TURN OFF to prevent operation without the monitor, or accidental discharge of the battery by forgetting to turn the unit OFF after use.

With reference to FIG. #1 and FIG. #2, the pulley system is shown in relation to the basic physics of the forces. In FIG. #1, the 15 pound weight A1 is capable of balancing the 30 pound weight B1, because of the reversal around the Ap and Bp pulleys. The foot pounds of force are balanced because the 15 pound weight A1 would have to move twice as far as the 30 pound weight B1, when force is applied downward by the weight A1.

In FIG. #2 the tie point of the cord in FIG. #1 has been replaced by a fixed pulley and an additional 15 pound weight A2. Both the A1 and A2 weights combine to balance the 30 pound weight B1.

FIG. #3 is a general Schematic of the Operator Actuated Traction System; which can be related to the basic pulley system in FIG. #2. The Operator 19 grasps the Hand Stirrups 13A,13B, which are located at approximately at the level of the seat 15*a* of the Operators Chair 15. When the Operator presses down with each hand with an equal force of, for example, 15 pounds, the Pulley P5 and Monitor Unit 5 will be moved upward with a force of 30 pounds.

The pulley P5 is pivotly fastened to the slidably mounted Monitor Unit 5 that is connected to the Tension Cord 18 which, in turn, is connected to the Adjustable Hanger Assembly 8. The Operators Head Harness 10 is fastened by the Snap Hooks or link means 12A,12B to the Adjustable Hanger Assembly 8 as noted the Head Harness 10 includes the chin strap 10*a* and the head strap 10*b*. The Adjustment Knob 9, when turned, winds up the Tension Cord 18 until the cord is taught, and the Operator 19 is sitting in a completely erect position. The vertical movement of the slidably mounted Monitor Unit 5 is, therefore, limited to the actual stretching of the Operators body, when traction pressure is applied.

By the laws of Action and Reaction, whatever pressure is applied downward by the Operator 19 to the Hand Stirrups 13A,13B will be matched by and equal and opposite set of forces 14A and 14B on the corresponding shoulders of the Operator. Also, as shown in FIG. #2, the upward forces 14A,14B on the shoulders, will always be limited to exactly one-half of the upward force on the Head Harness 10.

The above set of built-in conditions is very important to the successful operation of the Cervical (upper spine) Traction System invention.

FIG. #4 shows a side view of an Operator 19 utilizing the invention. Notice that the Housing 1 is mounted via a Keyhole Bushing 3 on a Wall Mounted Bracket 2. The Operator 19 has his Head Harness 10 connected to the Adjustable Hanger Assembly 8 via the Clips 12A,12B, which, in turn, is connected to the Monitor Unit 5 over a center pulley (not shown for clarity). The Operator 19 has already tightened the Tension Cord 18 with the Adjust Knob 9, and he is seated on a folding chair 15, with his back against the Wall or Vertical member 17, with his hands grasping the Hand Stirrups 13A,13B; and applying downward pull to the Tension Cords or Cable means 6A and 6B; with a downward pressure of his hands on the Hand Stirrups 13A,13B.

The electronic Monitor Unit 5 is free to move vertically along the slope of the Front Panel 1, as shown in FIG. #4. The Monitor Unit 5 is lifted by its attached Pulley P5 ,which is hidden by the side view of FIG. #4.

The slidably mounted Monitor Unit 5 has Control Knobs 7, which can be used to preset the traction limit desired; the duration of the maximum traction; and the delay time between traction cycles. When the Operator 19 reaches the Pressure Limit he has set into the Monitor Unit 5, he will hear a steady tone, which will last as long as the Dwell Time he has preset into the Control Unit. At the end of the tone signal the Operator can relax the pressure on the Cords 6 until he hears a short beep from the Monitor Unit 5; which signals the start of a new cycle. Should the Operator apply over 5 pounds too much pressure to the Tension Cords 6A and 6B, he will hear a rapid series of beeps, which sound like an ALARM. Approximately 2 minutes after the Operator 19 has finished using the System, the Monitor Unit 5 will TURN OFF Automatically.

A detail of some of the key parts in the Monitor Unit 5 is shown in FIG. #5 and FIG. #6. The unit is shown with the Housing 1 and the control knobs 7 removed, for clarity. The unit has notched sides 5A, which are made of lubrous plastic, such as Delrin, that slide in a rectangular slot in the face of the Housing 1. There is a Guide Rail or track means in the Monitor Unit 5 which holds a Spring Retainer Block 21 that retains the top of the Tension Measuring Spring 20. The bottom of the Spring 20 is retained on the Cord Bushing 23 mounted on the bottom of the Monitor Unit 5, which also guides the Tension cord 18 where it emerges from the bottom of the Monitor Unit 5. A Switch Mounting Plate 24 is fastened to the moving Spring Block 21 which moves the Micro Switch 25 downward with the Spring Block 21, in proportion with the compression of the Spring 20; as caused by the Tension force exerted on the Operator 19 thru the Hanger Assembly 30 and the attached Head Harness 10.

An Arm 27 on the Micro Switch 25 contacts the edge of the Tension Adjust Block 26 when the Arm 27 is moved down to the preset position of the Adjust Block 26; and a switch closure is produced, which activates conventional solid state circuitry, to sound the pressure limit warning signal. It is obvious that the further down the Adjust Block 26 is set, the more pressure will be required to cause the switch closure. The Spring 20 thereby acts as a monitoring Scale at all times, with the preset position of the Adjust Block 26 determining the level of traction pressure at which the Micro Switch Arm 27 will cause a contact; and activate the circuitry that produces the audio tone that will sound for the DWELL duration that has been set-in by the operator.

The Monitor Box 5 also contains the Printed Circuit Board 28 which mounts the components for the timing circuitry and the "buzzer" control, which is connected to a built-in battery 38 thru the Automatic Shut-Off circuit that will allow the battery to last for a year or more of typical usage. Another Offset Switch 25B, which is similar to Switch 25, and which is not shown for clarity, senses the five-pound-over-pressure-point for the control circuitry, and produces a fast intermittant ALARM tone.

The Fixed Pulley P5 is mounted on the slidable Monitor Unit 5, to allow the unit to move vertically with the tension or Operator Cords 6, without regard to the relative positions of the Left and Right hands of the Operator 19; as shown in FIG. #3.

FIG. #7 and FIG. #8 show the essential details of the Adjustable Hanger Assembly 8, which provides three important features:

FIRST, the Hanger Assembly provides for horizontal spacing of the two Snap Hooks 12A, 12B.

SECOND, the assembly has a Wind-Up Spool or Sprocket drum 32, that is part of the External Knurled Knob 33; for taking up the slack in the Tension Cord 18 during the set-up adjustment for each individual Operators height.

THIRD, a Ratchet Pawl Assembly 34, which is pivotly mounted within the unit, interacts with the ratchet teeth on the Wind-Up Spool 32 to prevent the position of the Adjustable Hanger Assembly 8 from changing after adjustment. The Pawl Release Button 36, which is part of the Ratchet Pawl Assembly 34, allows instant release and extension of the Tension Cord 18, when it is depressed by the thumb of the operator; for easy and quick removal of the Head Harness 10.

The Guide Spacer 31 is one of three Spacers that are screwed between the two Sides 30A and 30B of the Hanger Assembly 30, to give the Assembly rigidity. In addition, the Spacer 31 acts as a Guide for the Tension Cord 18. For simplicity, the External Knurled Knob 33 and the Sprocketed Drum 32 are molded as a single piece. The Ratchet Pawl Assembly 34 and its associated Release Tab or Button 36 is also a single molding, which is slidably retained by a bearing notch in the associated guide spacer 31, and held normally down by Spring 35. The guide spacer 31, the wind-up spool 32 and the rachet pawl assembly 34 act as connecting mechanism.

Two Coupling Rings 37A,37B are also part of the Adjustable Hanger Assembly 8, with their associated Snap Hooks 12A,12B;, which allow quick change of the personalized Cloth Head Harness 10.

In summary, the invention provides an economical and easily manipulated machine for self rehabilitation of a high percentage of functional back problems in the Cervical area; such as those incurred in typical "whip lash" injuries. A unique feature of the machine is a built-in Monitor Unit, which has a spring scale and electronic circuitry to instantly alert the Operator to the set pressure limits and cycle durations that are prescribed by his physician. These special features, plus simplicity and ease of set-up, have been outlined in the operational description and in the following appended claims;

I claim:

1. Cervical traction apparatus comprising:

a vertical member;

patient support means having a horizontal seat for supporting a patient in a sitting position located adjacent said vertical member;

a pair of hand stirrups located on opposite sides of said horizontal seat;

a housing disposed above said horizontal seat and connected to said vertical member;

a monitor unit slideably mounted on said housing, the monitor unit including a monitor pulley;

a hanger assembly disposed below said monitor unit;

connecting means connecting said monitor unit and said hanger assembly;

head harness means located below said hanger assembly, the head harness means including a chin strap to fit underneath the chin of a patient and extend upwardly on opposite sides of and beyond the top of the patient's head, and a head strap to fit under the back of the head of a patient and extend upwardly on opposite sides of and beyond the top of the patient's head;

first link means connected with the upwardly extending portions of the chin strap and head strap on one side of the patient's head and also connected to one side of said hanger assembly;

second link means connected with the upwardly extending portions of the chin strap and head strap on the opposite side of the patient's head and also connected to the opposite side of said hanger assembly;

a first pair of pulleys located above said monitor unit and connected with said housing with their horizontal axes extending horizontally;

a second pair of pulleys located above said monitor unit and connected with said housing with their horizontal axes extending horizontally; and cable means connected to one of said hand stirrups and extending up and over said first pair of pulleys and thence downwardly and under said monitor pulley and then upwardly and over said second pair of pulleys and thence downwardly to said second hand stirrup.

2. The apparatus of claim 1 wherein said connecting means includes:

vertically oriented track means in said monitor unit;

a compression spring mounted to extend parallel with said track means, one end of the compression spring engaging and supported by the monitor unit;

a spring retainer block mounted in said track means and engaging the other end of said compression spring;

a tension cord extending through said compression spring one end of which is connected to said spring retainer block; and mechanism connecting the opposite end of said tension cord to said hanger assembly.

3. The apparatus of claim 2 further including:

a micro switch including a switch arm mounted on said spring retainer block for movement therewith; and a tension adjustment block adjustably mounted on said unit to be engaged by said arm.

4. The apparatus of claim 2 when said hanger assembly includes:

a guide spacer for receiving and passing said tension cord;

a rotatably mounted spool upon which said tension cord is wound, the spool having ratchet teeth around the periphery thereof;

means for rotating said spool to adjust the rotational position thereof;

a rachet pawl engaging said ratchet teeth; and means for disengaging said rachet pawl from the teeth.

* * * * *